United States Patent [19]

McHam

[11] 4,292,332

[45] Sep. 29, 1981

[54] CONTAINER FOR PREPACKAGING, POPPING AND SERVING POPCORN

[76] Inventor: David E. McHam, 16061 E. Kellogg, Wichita, Kans. 67230

[21] Appl. No.: 870,838

[22] Filed: Jan. 19, 1978

Related U.S. Application Data

[63] Continuation-in-part of Ser. No. 684,719, May 10, 1976, abandoned.

[51] Int. Cl.[3] ..... B65D 81/34; B65D 65/28

[52] U.S. Cl. ..... 426/111; 206/620; 206/626; 229/62.5; 229/DIG. 14; 426/113; 426/118; 426/234

[58] Field of Search ..... 426/111, 113, 115, 118, 426/122, 234, 243, 395, 412, 107; 229/DIG. 14, DIG. 8, 62.5; 220/89 A, 366, 367, 361; 215/253; 206/620, 626

[56] References Cited

U.S. PATENT DOCUMENTS

| | | | |
|---|---|---|---|
| 2,726,002 | 12/1955 | Dalianis | 220/89 A |
| 3,054,680 | 9/1962 | Mennen | 426/111 |
| 3,185,578 | 5/1965 | Scharre | 426/114 |
| 3,323,442 | 6/1967 | Rader | 229/DIG. 14 |
| 3,425,845 | 2/1969 | Dunn | 426/111 |
| 3,671,270 | 6/1972 | Jehn | 426/111 |
| 3,835,280 | 9/1974 | Gades et al. | 426/111 X |
| 3,851,574 | 12/1974 | Katz et al. | 426/107 |
| 3,873,735 | 3/1975 | Chalin et al. | 426/113 |
| 3,973,045 | 8/1976 | Brandberg et al. | 426/111 |
| 4,036,423 | 7/1977 | Gordon | 426/111 |

FOREIGN PATENT DOCUMENTS

| | | | |
|---|---|---|---|
| 466360 | 7/1950 | Canada | 426/115 |
| 671933 | 5/1952 | United Kingdom | 426/396 |

*Primary Examiner*—Steven L. Weinstein
*Attorney, Agent, or Firm*—Robert E. Breidenthal

[57] ABSTRACT

An expansible and disposable container for popping popcorn prepackaged with cooking oil therein in a microwave oven; such container being made of a material impervious to cooking oil and having its upper side provided with a pattern of weakness that serves as an excess vapor pressure release during the popping and which thereafter serves for convenient opening of the container so that the latter can be used as a serving tray.

7 Claims, 9 Drawing Figures

FIG. 1
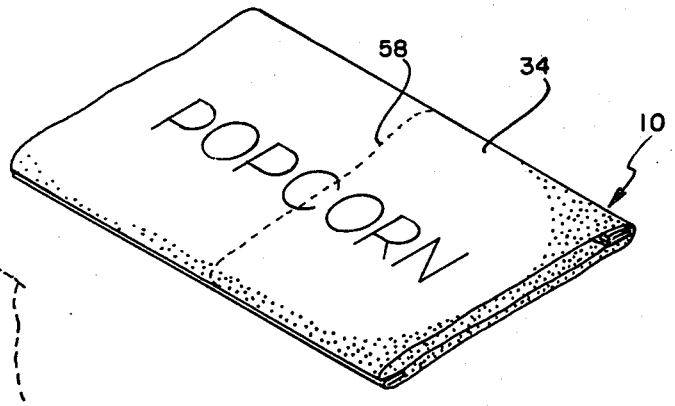
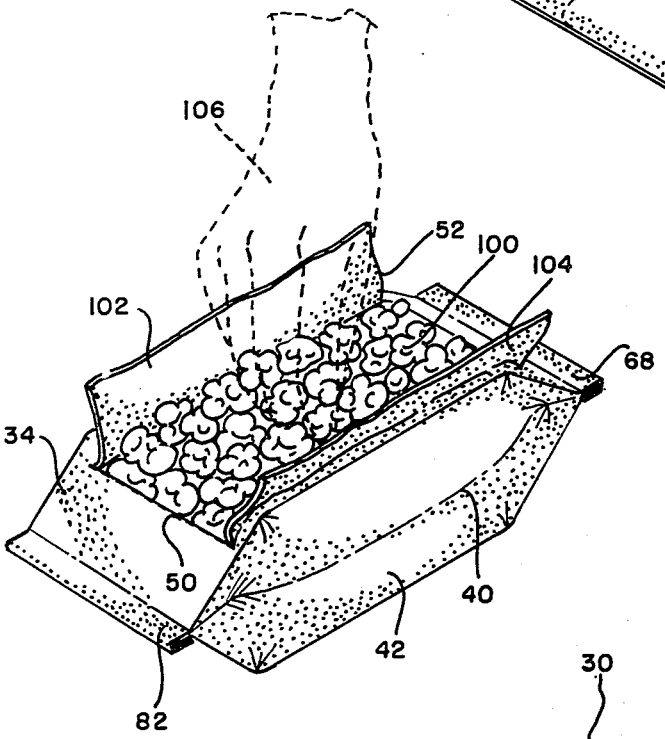
FIG. 2
FIG. 3
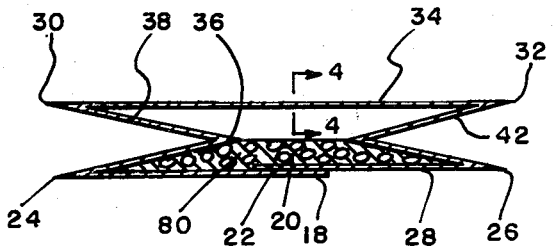
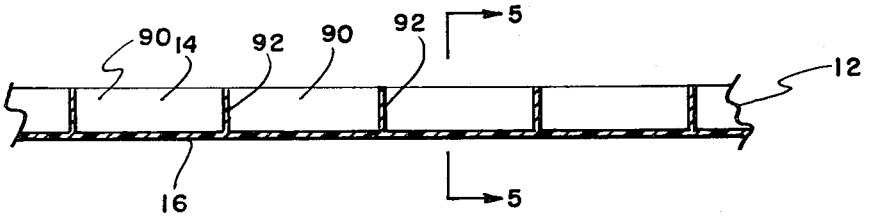
FIG. 4

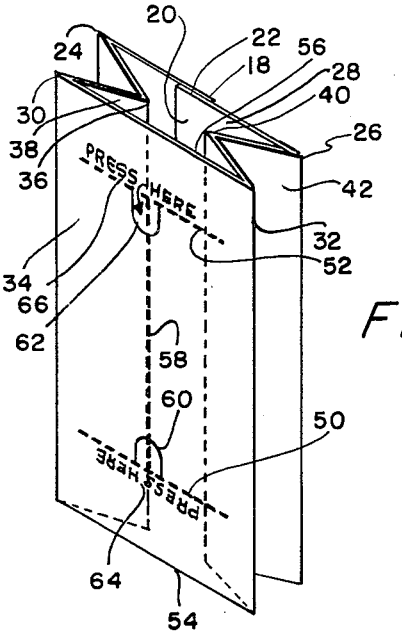
FIG. 6
FIG. 7
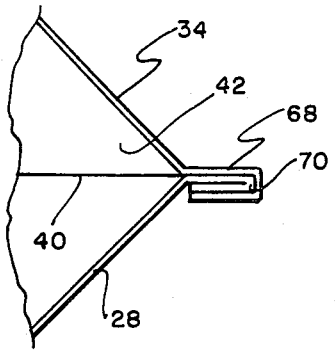
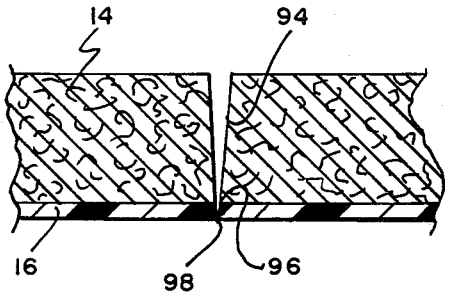
FIG. 5
FIG. 8
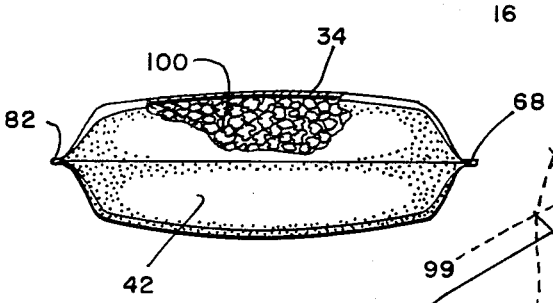
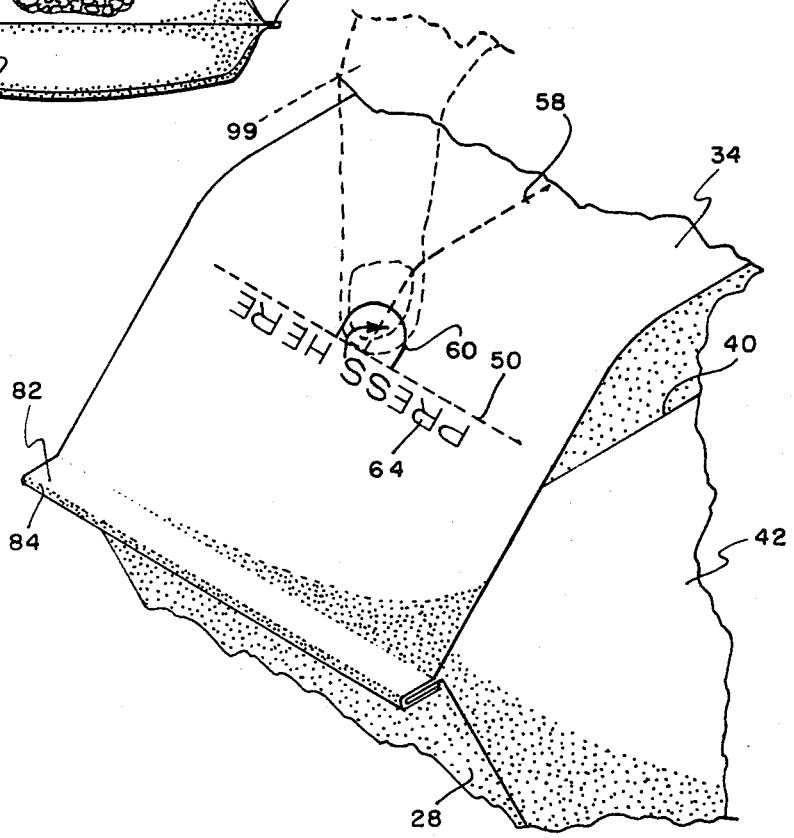
FIG. 9

CONTAINER FOR PREPACKAGING, POPPING AND SERVING POPCORN

This application is a continuation-in-part of my copending application entitled CONTAINER FOR COOKING AND SERVING POPCORN that was filed May 10, 1976, and which bears application Ser. No. 684,719, now abandoned.

The invention relates to new and useful improvements in food packaging, and pertains more particularly to the packaging of food in a container suitable for initially heating and/or cooking food prepackaged therein and which container can thereafter be readily and easily opened to serve as a serving tray for its contents without the necessity for further seasoning or preparation.

Proposals have heretofore been made for the popping of popcorn in a microwave oven, such popcorn with cooking oil being contained in a container in which they are prepackaged. Such prior art proposals have extended to such containers being provided with tear tabs, tear strips, scoring or the like, for the opening of the container after removal from the microwave oven.

An appreciation of prior art proposals may be readily acquired by those unfamiliar with the art on reference to U.S. Pat. No. 3,851,574, entitled HEAT AND MOISTURE ACTIVATED SAVORY COATING SYSTEM FOR POPCORN, which issued to Katz et al on Dec. 3, 1974; U.S. Pat. No. 3,835,280, entitled COMPOSITE MICROWAVE ENERGY PERTURBATING DEVICE, which issued to Gades et al on Sept. 10, 1974; and U.S. Pat. No. 3,873,735, entitled FOOD PACKAGING FOR HEATING AND VENTING, which issued to Chalin et al on Mar. 25, 1975.

It appears that none of the prior art container proposals are satisfactory or meet all desideratums of such containers. Among such desideratums is that the container be sufficiently impervious to cooking oil so that the latter will not weep or bleed through the same during a reasonable grocery store shelf life (say, six to nine months) at room temperature, nor during the ensuing cooking container and serving tray use of the container. Other important desideratums are that the container will not rupture or prematurely open, that is during cooking, due to heat and/or pressure in the container during its shelf life; that the container can be easily opened after its contents have been cooked and still piping hot; and that the geometry of the opened container be such that it can rest in a stable fashion on a flat surface or across the knees of the user while exposing its food content through its opening for easy access thereto. Other desideratums are that the container with its prepackaged content be attractive in appearance, economical and preferably also readily adapted to either being dispensed by way of coin operated vending machines, or used in association with coin operated vending and automatic processing machines of the type that include a microwave oven.

A broad aspect of the invention involves an unpopped popcorn container suitable for containing the popcorn during the popping thereof in a microwave oven and openable thereafter to function as a serving tray for the popped popcorn, said container comprising a closed bag of flexible sheet material, said bag including generally rectangular top and bottom walls each having a pair of opposite end edges and a pair of opposite side edges, said bag including a pair of pleated side walls respectively joining the opposite side edges of the top and bottom walls, each of said pleated side walls having an extended height less than the spacing between the opposite side edges of the bottom wall, said top wall being provided with a spaced pair of lines of weakness that are respectively spaced adjacent to and extend along the edges of one of the pairs of opposite edges of the top wall with each of said lines terminating at positions spaced from both edges of the other of the pairs of opposite edges of the top wall, and the top wall also being provided with a connecting line of weakness connecting the lines of the pair of lines of weakness at positions intermediate along the extents of the latter, with said connecting line of weakness being substantially spaced from both edges of said other of the pairs of opposite edges of the top wall along its entire extent, and a charge of unpopped popcorn in the bag.

A more limited aspect of the invention involves the structure set forth in the preceding paragraph wherein said sheet material is substantially fluid impervious, and wherein at least a portion of at least one of the lines of weakness constitutes an excess pressure relief means in that the same has longitudinally spaced increments of length having a frangibility such that they will rupture in response to vapor pressure within the bag exceeding a predetermined superatmospheric pressure, such pressure being less than that required to otherwise disrupt the integrity of the bag.

Another broad aspect of the invention involves a cooking bag comprising a fluid impervious and expansible container formed of a flexible sheet material, said sheet material being comprised of kraft paper having a fluid impervious coating of a synthetic resin on one side thereof, said one side of the paper being on the innermost side of the container, said container being provided with a common means for relieving the container of any internal pressure sufficient to disrupt the container and also for enabling opening of the container, said common means comprising the sheet material having an intermittent line of scoring, with such line of scoring being from the side thereof opposite said one side and of a depth only partially penetrating the resin coating to an extent that the latter is frangible at a superatmospheric pressure that is less than that required to disrupt the integrity of the container.

Other objects, features, aspects and advantages of the invention will become apparent during the ensuing description of a preferred embodiment of the invention, the same being given in conjunction with the accompanying drawings, wherein:

FIG. 1 is an isometric view of the bag, the same having concealed therein a charge of unpopped popcorn with cooking oil and being shown with the two remote thirds of the length of the bag folded thereunder for compact storage in a vending machine or sales counter display;

FIG. 2 is an isometric view on a reduced scale of the bag of FIG. 1 after the bag has been unfolded, the contents thereof popped in a microwave oven, and after the bag has been opened to expose and serve the popcorn to the grasp of the hand of the consumer shown in dashed outline;

FIG. 3 is a central and vertical transverse sectional view through the bag and its prepackaged contents, the view being taken with the bag partially opened to display the character of the pleated side walls;

FIG. 4 is a greater enlarged and somewhat stylized sectional detail view taken along one of the lines of weakness or scoring of the top wall, the view being taken in the plane of the section line 4—4 of FIG. 3;

FIG. 5 is a still further enlarged and somewhat stylized vertical sectional detail view, the same being taken upon the plane of the section line 5—5 in FIG. 4;

FIG. 6 is an isometric view on a reduced scale of the bag during an intermediate stage of its fabrication;

FIG. 7 is an enlarged fragmentary side view of an end of the bag to illustrate the manner in which the heat sealed ends thereof are folded, the bag being shown with its pleated side wall expanded;

FIG. 8 is a side view on a reduced scale of the bag expanded by the popping of its popcorn content, with a part of the bag removed to expose the popped popcorn therein; and, FIG. 9 is an enlarged and fragmentary isometric detail view of an end of the bag expanded by popped popcorn therein, and illustrates particularly the pattern of the lines of weakness or scoring and the placement of opening indicia adjacent the juncture of lines inviting the application of finger pressure as by a finger shown in dashed outline.

Referring now to the drawings wherein like numerals designate like parts throughout the various views, the reference numeral 10 designates the bag or container of the instant invention.

The bag 10 is formed of a single piece of a flexible sheet of material 12.

Inasmuch as the properties of the sheet of material 12 are important to the desired operation (indeed to economic fabrication) of the bag 10, attention is initially given to the same. The sheet of material 12 is of integral and composite character, and is preferably comprised of a flexible sheet of paper such as 50-pound kraft paper 14 (see FIGS. 4 and 5); which paper 14 can be unbleached, bleached, or have any desired color imparted thereto; having a coating or layer of a synthetic resin or plastic 16 firmly adhering to one side thereof.

The resin or plastic is of such nature and thickness as to render the sheet of material 12 essentially entirely impervious to fluids applied to the coated side thereof, and in particular, impervious to common cooking oil or fats such as used in the popping of popcorn, for a protracted period greater than six months (such period being more than should occur from bag manufacture to consumer use).

The nature and thickness of the layer 16 is selected to be such as to be impervious to cooking oils and fats under normal warehousing and sales shelf conditions for at least six months, but additionally, is such as to withstand the passage of cooking oil or fat therethrough during the popping of corn in the bag 10 and for a reasonable popcorn serving time thereafter. The use of the expression "fluid impervious" in this specification and in the appended claims shall be interpreted as being appropriate when the sheet of material 12 meets the qualifications set forth above.

In the preferred practice of the instant invention, the resin or plastic of the layer 16 is selected to be such as to enable the bag 10 to be fabricated by conventional heat sealing techniques.

It has been found that excellent results are obtained when the plastic layer 16 is a polyester resin such as commonly used in the packaging of food products. The polyester is applied to the paper 14 in any suitable manner to firmly adhere to the latter, preferably with some degree of interlocking or embedding of fibers of the paper in the resin or plastic layer 16. In the preferred form of the invention the resin or plastic material, apart from a degree of interlocking at the paper-plastic boundary region, does not saturate, impregnate, or substantially fill the voids of the paper 14, as such would not only inordinately increase the cost of sheet material 12, but increase the difficulty and/or expense of printing indicia of labels on the paper after the same has been resin impregnated.

The layer or coating of plastic or synthetic resin is found to be economic and sufficiently fluid impervious for the purpose of the instant invention when applied to the kraft paper in an amount ranging from about 8 to about 30 pounds per 1000 square feet of paper.

Sheet material 12 is ideally suited to the practice of the instant invention is commercially available from Thilmany of Thilmany Rd., Kaukauna, Wisconsin 54130, under the trademark SURCOTE. Specifically, composite sheet material from such source bearing catalog number 100-003-ol and carrying the following designations 45 pounds—No. 53000 White or Tan XKL/18 pounds has been employed in the practice of the instant invention with outstanding results. Such composite sheet material is constituted of 50-pound kraft paper having a layer of resin or plastic fixed on one side thereof of uniform thickness. The layer 16 of plastic or resin is understood to be a polyester with the same applied to the paper by spraying. The polyester may be applied to the paper prior to completion of the esterification process. The thickness corresponds to about 12 pounds of plastic or resin per 1000 square feet of paper. The plastic may be applied at a rate greater or lesser, if desired. The lower limit must be at least great enough to not only preserve the prepackaged popcorn in a sanitary condition, but to achieve the requisite degree of imperviousness to fluids—the essential preclusion of cooking oil or fat weeping or bleeding into the paper layer 14 during shelf life, the popping operation, and the serving time. Such lower limit has been found to be about 8 pounds of plastic per 1000 square feet of paper, but the use of a greater amount is usually to be recommended. As the cost of the sheet 12 goes up rapidly with increased thickness of the layer, the upper limit is set in practice by cost considerations, with about 30 pounds per 1000 square feet being presently considered to be such an upper limit. Greater amounts can be used, especially if the economic considerations permit, however, no real need therefor is seen as 30 pounds of plastic per 1000 square feet are ordinarily more than sufficient to confer upon the sheet 12 all the desideratums thereof.

The bag 10 is formed of a single rectangular piece of the sheet material, the layer 16 innermost with the same being formed as a tube (see FIG. 6) with opposite side margins 18 and 20 being overlapped and conventionally heat sealed together as at 22, with the resin or plastic layer 16 of the outer overlapping portion 18 of the sheet material 12 bonding and sealing during the heat sealing process to the outer paper side 14 of the overlapping portion 20 of the sheet material 12.

The tube form effected by the heat sealing 22 is longitudinally creased at 24 and 26 on opposite sides of the heat sealing 22 to define a bag bottom wall 28, with the heat sealing 22 being approximately centered transversely of the bottom wall 28. The tube is also longitudinally creased at 30 and 32 to define therebetween a bag top wall 34 identical in size to the bottom wall 28.

A crease 36 is positioned midway between the parallel creases 24 and 30 to define a pleated or expansible bag side wall 38. Similarly, a crease 40 is centered between the parallel creases 26 and 32 to define a pleated or expansible bag side wall 42 identical to the side wall 38.

Prior to the above described heat sealing and creasing of the sheet of material 12, the part thereof to constitute the top wall 34 is provided with an H-shaped configuration of lines of weakness and certain indicia. The lines of weakness include two parallel lines of weakness 50 and 52 respectively parallel to and spaced from the opposite ends 54 and 56 of the top wall. The extremities of the lines of weakness 50 and 52 are spaced from the side edges (creases 30 and 32) of the top wall 34. A line of weakness 58 that is centered between and parallel to the creases 30 and 32 has its extremities coinciding and forming junctures with the midpoints to the lines 50 and 52 to complete therewith the H-shaped pattern. It is suffice to appreciate at this point that the lines of weakness 50, 52 and 58 are such as to enable manual rupture of their extents in the opening of the bag 10 for gaining access to the popped contents thereof. The indicia is for the purpose of inviting finger pressure at locations adjacent the end points of the line 58 (its junctures with the lines 50 and 52) in order to most easily initiate the manual ruptures of the top wall 34 along the lines 50, 52 and 58, and comprise printed semicircles 60 and 62 overlying the line 58 and partially encircling the endpoints thereof as shown. The indicia also includes adjacent each of the semicircles 60 and 62 the printed legend "PRESS HERE" and an arrow 64 and 66 directed to the interior of the semicircle 60 (and 62) proximate thereto.

The tube shown in FIG. 6 has one longitudinal end closed and collapsed (side walls 38 and 42 contacting the top and bottom walls 34 and 28, and the latter contacting each other intermediate the creases 36 and 40) and such end of the tube is heat sealed closed at 68, and thereafter such heat sealed end portion is folded upon itself as shown at 70 in FIG. 7 for imparting additional strength and rigidity to such closed end of the tube. Such end sealing or closing of an end of the bag 10 undergoing fabrication involves the inner (coated) side of the side wall 38 between the creases 24 and 36 sealing to the bottom wall 28 and between the creases 30 and 36 sealing to the top wall 34, it being noted that the layer 16 will heat bond or seal to itself as well as to uncoated paper 14. The inner side of the side wall 42 bonds to the top and bottom bag walls 34 and 28 in an analogous fashion. While the fold 70 tends to hold the side walls 38 and 42 collapsed adjacent the heat seal 68, the outer sides of such side walls do not bond or seal together.

With one end of the tube closed and heat sealed 68 with fold 70, a charge 80 of unpopped popcorn with a cooking oil, which may be coconut oil, and a flavor imparting agent, which may be saffron oil, is placed therein. It should be observed that the oil and flavoring agent is not essential to the popping of the popcorn to produce a tasty and edible product, the addition of the same appears to be objectionable to none while enhancing the taste and aroma to the judgment of most persons. Such also is believed to warrant the prepackaged popcorn being designated by such terms as "buttery flavored", etc.

With a bag 10 dimensioned as hereinafter set forth, a charge of about $3\frac{1}{2}$ ounces of popcorn and about 0.5 or less ounces of coconut oil can be employed. Needless to say, other oils or fats can be used in lieu of coconut oil such as corn oil, peanut oil, butter, and animal fats such as lard. Other flavoring agents such as dried cheese, cinnamon, caramel, etc., can be employed.

After the bag 10 has been charged, the open end is closed and heat sealed at 82 and folded at 84 in a manner analogous to that wherein the heat seal 68 and the fold 70 were effected at the other end of the bag 10.

By way of example only, it has been found that a completed bag 10 having the following dimensions is well suited to the popping of a $3\frac{1}{2}$ ounce charge of popcorn. The top and bottom walls 34 and 28 measuring $5\frac{3}{4}$ inches between their junctures with the side walls 38 and 42 and $11\frac{1}{8}$ inches between their heat sealed opposite ends. The side walls 38 and 42 each have an overall vertical height of $2\frac{7}{8}$ inches.

The "H" configuration is centered along the length of the top wall 34 with the lines 50 and 52 each being $4\frac{1}{2}$ inches in length and the line 58 being 6 inches long.

The character of the lines of weakness 50, 52 and 58 are of special significance in that they serve an additional function to that alluded to previously in that they additionally constitute a pressure relief means such as to preclude the vapor pressure generated within the bag 10 during the popping of its contents from disrupting the integrity of the bag 10. Obviously, it is undesirable that vapor or steam pressure open any of the heat seals, cause extended rips along any of the lines of weakness, or otherwise disrupt the integrity of the bag 10 to such an extent that any of the charge 80 (popped or unpopped) escape the confines of the bag 10 while still in a microwave oven. In order to avoid such undesirable consequences while still allowing vapor pressure to distend or properly expand the bag 10 to a shape such as shown in FIG. 8, the lines of weakness 50, 52 and 58 are formed by conventional intermittent or dashed-like scoring techniques, with such scoring being effected from the side of the sheet of material 12 opposite the plastic or resin layer 16 component thereof. The actual scoring, that is the crushed and cut intervals 90, are spaced by unscored segments 92 (see FIG. 4), and such intervals 90 are of a depth to extend through the paper layer 14 as shown at 94 and to penetrate or weaken a fraction only of the thickness of the resin or plastic layer 16 as indicated at 96. The remaining fractional thickness 98 of the plastic or resin layer 16 has sufficient thickness to prevent food contamination and sufficient strength to withstand bag expanding pressures, but insufficient strength to withstand pressure that can disrupt or prematurely open the bag 10. The width of the line of penetration of the plastic or resin is so small that no significant weeping of oil therethrough can occur even when the unpenetrated fraction 98 is very thin, say, on the order of about one thousandth of an inch. Such thinness will allow the same to yield along the intervals 90 and to open for the passage of steam or vapor therethrough. It is not necessary that the complete extents of the lines 50, 52 and 58 all be specially scored or weakened as described above, and such special scoring along any one or any two of such lines 50, 52 and 58 will suffice to effect the necessary degree of pressure relief.

The bag 10 is preferably folded into thirds with the charge 80 disposed in the center third of the bag 10 as shown in FIG. 1 for self-display or storage in vending machines.

To pop the contents of the bag 10, the latter is unfolded from the folded condition of FIG. 1, and placed in a microwave oven (not shown) with the top wall 34 uppermost. After the requisite cooking interval (usually about two to five minutes depending upon the corn moisture content), the bag 10 (which will have expanded to the form shown in FIG. 8 with excess vapor pressure released therefrom) is removed from the microwave oven. The bag 10 can be placed on any flat surface or, if desired, across the knees of the consumer, on which it will stably rest. Finger 99 pressure is then applied as invited by the indicia and the lines of weakness 50, 52 and 58 opened by pressure along the lines 50, 52 and 58 against the yielding popped corn 100 therein. After the lines 50, 52 and 58 are opened, portions 102 and 104 of the top wall 34 can be folded back as flaps as shown in FIG. 2 so as to be exposed to the hand 106 of the user.

The fact that the sheet of material 12 is fluid impervious and the geometry of the bag 10 enables the latter to serve as a serving tray that does not have to be hand held while picking corn with the other hand, and makes use as a tray such as not to soil table covers, furniture or clothing of the user.

Attention is now directed to the appended claims.

I claim:

1. An expansible unopened popcorn container suitable for containing the popcorn during the popping thereof in a microwave oven and openable thereafter to function as an open topped serving tray for the popped popcorn, said container comprising a closed bag of flexible sheet material, said bag including generally rectangular top and bottom walls each having a pair of opposite end edges and a pair of opposite side edges, said bag including a pair of pleated side walls respectively joining the opposite side edges of the top and bottom walls, each of said pleated walls having an extended height less than the spacing between the opposite side edges of the bottom walls, said top wall being provided with a spaced pair of lines of weakness that are respectively spaced adjacent to and extend along the edges of one of the pairs of opposite edges of the top wall with each of said lines terminating at positions spaced from both edges of the other of the pairs of opposite edges of the top wall, and the top wall also being provided with a connecting line of weakness connecting the lines of the pair of lines of weakness at positions intermediate along the extents of the latter, with said connecting line of weakness being substantially spaced from both edges of said other of the pairs of opposite edges of the top wall along its entire extent, and a charge of unpopped popcorn in the bag with the latter in a collapsed condition, said sheet material being substantially fluid impervious, and at least a portion of at least one of the lines of weakness constituting an excess pressure relief means in that said portion of the lines of weakness is defined along its length by the sheet material having scoring in the form of lineally spaced elongated increments of scoring separated by unscored segments, each increment of scoring having a depth less than the thickness of the sheet material and a depth sufficient to constitute a frangibility such that the increments of scoring will rupture in response to vapor pressure within the bag exceeding a predetermined superatmospheric pressure, such pressure being less than that required to otherwise disrupt the integrity of the bag while the unscored segments remain intact, being manually rupturable when the bag is to be opened.

2. The combination of claim 1, wherein the pair of lines and the connecting line jointly are of an "H" configuration, and wherein the top wall is provided with indicia means inviting finger pressure at a juncture of the connecting line with one of the pair of lines.

3. The combination of claim 1, wherein the sheet material is of integral and composite character, the same being constituted of a sheet of kraft paper having one side thereof coated by a layer of synthetic resin, with the bag having said one side of the paper innermost, said end edges respectively of the top and bottom walls with adjoining portions of the pleated side walls being sealed together by having their plastic coatings heat fused together.

4. The combination of claim 1, wherein the sheet material is of integral and composite character, the same being constituted of a sheet of paper having one side thereof coated by a fluid impervious layer of synthetic resin, with the bag having said one side innermost, and wherein said increments of scoring are defined by the sheet material being scored from the side opposite said one side thereof to a depth that penetrates a fraction of the thickness of the layer of synthetic resin.

5. The combination of claim 4, wherein the pair of lines and the connecting line jointly are of an "H" configuration, and wherein the top wall is provided with indicia means at a juncture of the connecting line with one of the pair of lines constituted of printing inviting finger pressure at such location for the purpose of initiating tearing along the lines of weakness to open the bag.

6. The combination of claim 4, wherein said end edges respectively of the top and bottom walls with adjoining portions of the pleated side walls are sealed together by having their resin coatings heat fused together.

7. A cooking bag comprising a fluid impervious and expansible container formed of a flexible sheet material, said sheet material being comprised of kraft paper having a fluid impervious coating of a synthetic resin on one side thereof, said one side of the paper being on the innermost side of the container, a common means for both venting the bag solely when fluid pressure exceeds a predetermined superatmospheric pressure that is less than that which will otherwise disrupt the integrity of the bag, and for opening after its contents are cooked, said common means comprising the sheet material having an intermittent line of scoring which comprises cut intervals spaced by unscored segments with said cut intervals being of a depth which extends through the paper layer and penetrates a fraction only of the resin coating, the remaining fractional thickness of the resin coating in the cut intervals having sufficient thickness to prevent food contaimination and sufficient strength to withstand bag expanding pressure but is frangible at a superatmospheric pressure that is less than that required to disrupt the integrity of the container thus allowing the intervals to open for the passage of steam or vapor therethrough while the unscored segments remain intact being manually rupturable when the bag is to be opened.

* * * * *